US005223656A

United States Patent [19]

Higashi

[11] Patent Number: 5,223,656

[45] Date of Patent: Jun. 29, 1993

[54] MUSICAL TONE WAVEFORM SIGNAL FORMING APPARATUS WITH PITCH AND TONE COLOR MODULATION

[75] Inventor: Iwao Higashi, Hamamatsu, Japan

[73] Assignee: Yamaha Corporation, Hamamatsu, Japan

[21] Appl. No.: 657,516

[22] Filed: Feb. 19, 1991

[30] Foreign Application Priority Data

Feb. 20, 1990 [JP] Japan ..... 2-37467

[51] Int. Cl.[5] ..... G10H 1/12; G10H 1/14

[52] U.S. Cl. ..... 84/661; 84/DIG. 9; 84/DIG. 10

[58] Field of Search ..... 84/DIG. 10, 629, 706, 84/DIG. 26, 707, 630, DIG. 9, 622-625, 659-661

[56] References Cited

U.S. PATENT DOCUMENTS 4,130,043 12/1978 Niimi .
4,267,761 5/1981 Deutsch ..... 84/661
4,646,611 3/1987 Nagashima et al. ..... 84/DIG. 9
4,706,291 11/1987 Kakubo et al. ..... 84/DIG. 26
4,984,276 1/1991 Smith ..... 84/707
5,036,541 7/1991 Kato ..... 84/629

FOREIGN PATENT DOCUMENTS 38-40199 2/1963 Japan .
49-131115 12/1974 Japan .
60-4474 2/1985 Japan .

*Primary Examiner*—Stanley J. Witkowski
*Assistant Examiner*—H. Kim
*Attorney, Agent, or Firm*—Graham & James

[57] ABSTRACT

A musical tone waveform signal forming apparatus comprises a delay loop circuit, a filter circuit a drive signal generation circuit and a modulation control circuit. The drive signal generation circuit inputs a drive signal to the delay loop circuit so that a musical tone is formed in the delay loop circuit. The filter circuit filters the musical tone. The modulation control circuit changes the delay length of the delay loop circuit and the characteristics of the filter circuit thereby adding a modulation effect on the musical tone to be generated.

34 Claims, 3 Drawing Sheets

MUSICAL TONE WAVEFORM SIGNAL FORMING APPARATUS WITH PITCH AND TONE COLOR MODULATION

BACKGROUND OF THE INVENTION

1. Field of the Invention

The present invention relates to a musical tone waveform signal forming apparatus utilized as a sound source of electronic musical instruments, music education apparatuses, toys, and the like and, more particularly, to a musical tone waveform signal forming apparatus for receiving a musical tone control signal for steadily or time-serially controlling musical tone parameters such as a pitch, a tone color, a tone volume, and the like of a musical tone, and forming a musical tone waveform signal according to the input musical tone control signal.

2. Description of the Prior Art

As an apparatus of this type, an apparatus which utilizes a so-called delay feedback type decay tone algorithm for inputting a nonlinear signal to a delay loop system including a delay circuit to perform feedback arithmetic processing, thereby forming a musical tone signal (to be referred to as a delay feedback type musical tone waveform signal forming apparatus hereinafter) is known (for example, Japanese Patent Laid-Open No. Sho 63-40199).

The delay feedback type musical tone waveform signal forming apparatus physically approximates mechanical vibration systems of acoustic instruments such as strings of a bowed instrument, a tube body of a wind instrument, and the like by means of an electrical circuit. This apparatus is expected to be able to relatively naturally and faithfully synthesize a tone of a bowed instrument or wind instrument as well as a change in tone level by inputting a nonlinear signal corresponding to a movement of a contact between a bow and a string of a bowed instrument or a reed or an embouchure of a wind instrument to the delay loop.

However, a delay feedback type musical tone waveform signal forming apparatus which can reproduce a musical tone added with a vibrato effect to have high fidelity to an acoustic instrument has not been realized yet.

SUMMARY OF THE INVENTION

The present invention has been made in consideration of the conventional problems, and has as its object to provide a delay feedback type musical tone waveform signal forming apparatus which can reproduce a musical tone added with a vibrato effect to have high fidelity to an acoustic instrument.

In order to achieve the above object, a musical tone waveform signal forming apparatus of the present invention comprises a delay feedback type musical tone waveform signal forming apparatus comprising delay means for delaying a signal input thereto, wherein an output of the delay means is fed back to an input of the delay means so that a loop is formed; excitation means for inputting the signal to the loop so that a musical tone signal is formed in the loop; filter means for filtering the musical tone signal according to a filtering characteristic of the filter means; and modulation means for generating a modulation signal varying with a lapse of time, wherein delay length of the delay means and the filtering characteristic of the filter means are varied with a lapse of time based on the modulation signal whereby pitch modulation and tone color modulation is effected on the musical tone signal.

Japanese Patent Laid-Open No. Sho 63-40199 does not describe a detailed arrangement for adding a vibrato effect to a musical tone. On the other hand, it is conventionally considered that a vibrato effect is attained by only frequency modulation. For this reason, as prior arts associated with the vibrato effect, a device for varying a frequency of a musical tone waveform signal using a PLL (phase-locked loop), or a device for varying a frequency of a system clock (e.g., Japanese Patent Publication No. Sho 60-4474) is known. In either device, only a pitch of a musical tone is changed.

The present inventor found that a tone color is changed as well as a frequency when a vibrato effect is added, and achieved the present invention. For example, in a string instrument, a vibrato effect is added by vibrating a finger pressing a string. In this case, a pressed string point is changed in accordance with an inclination of a finger, thus changing a pitch. In addition, hardness of the finger pressing the string is also changed, thus changing a tone color. Table 1 below shows changes in musical tone and in musical tone parameters of a bowed instrument upon comparison between a case wherein a string is vertically pressed by a finger, as shown in FIG. 5A, and a case wherein a finger pressing a string is inclined, as shown in FIG. 5B. In FIGS. 5A and 5B, a bridge and a bowed string point are located on the right side of the finger. In Table 1, items in parentheses indicate parameters of an electrical circuit of a delay feedback type musical tone waveform signal forming apparatus.

TABLE 1

| Angle of Finger | FIG. 5A | FIG. 5B |
|---|---|---|
| Attenuation at Finger Tip | Small | Large |
| Reflection Coefficient at Finger Tip | Large | Small |
| (Filter Attenuation) | Small | Large |
| Pitch of Musical Tone | High | Low |
| (Delay Length) | Short | Long |

As can be seen from Table 1, in a bowed instrument, not only a delay length (pitch of a musical tone) but also characteristics of a reflection filter on a finger side (attenuation at a finger tip) are changed.

According to the present invention, in the delay feedback type musical tone waveform signal forming apparatus, when a modulation effect such as a vibrato effect is to be added, both a total delay amount and filter characteristics are changed in accordance with an output from the modulation instruction means. In the delay feedback type musical tone waveform signal forming apparatus, when the total delay amount is changed, a pitch of a musical tone is mainly changed. When the filter characteristics are changed, a tone color of a musical tone is mainly changed.

Therefore, according to a musical tone waveform signal forming apparatus of the present invention, when a modulation effect is added, a pitch and a tone color of a musical tone are synchronously changed, and a modulated musical tone approximate to that of an acoustic instrument can be formed.

DETAILED DESCRIPTION OF THE PREFERRED EMBODIMENT

An embodiment of the present invention will be described in detail hereinafter.

Figure 1:
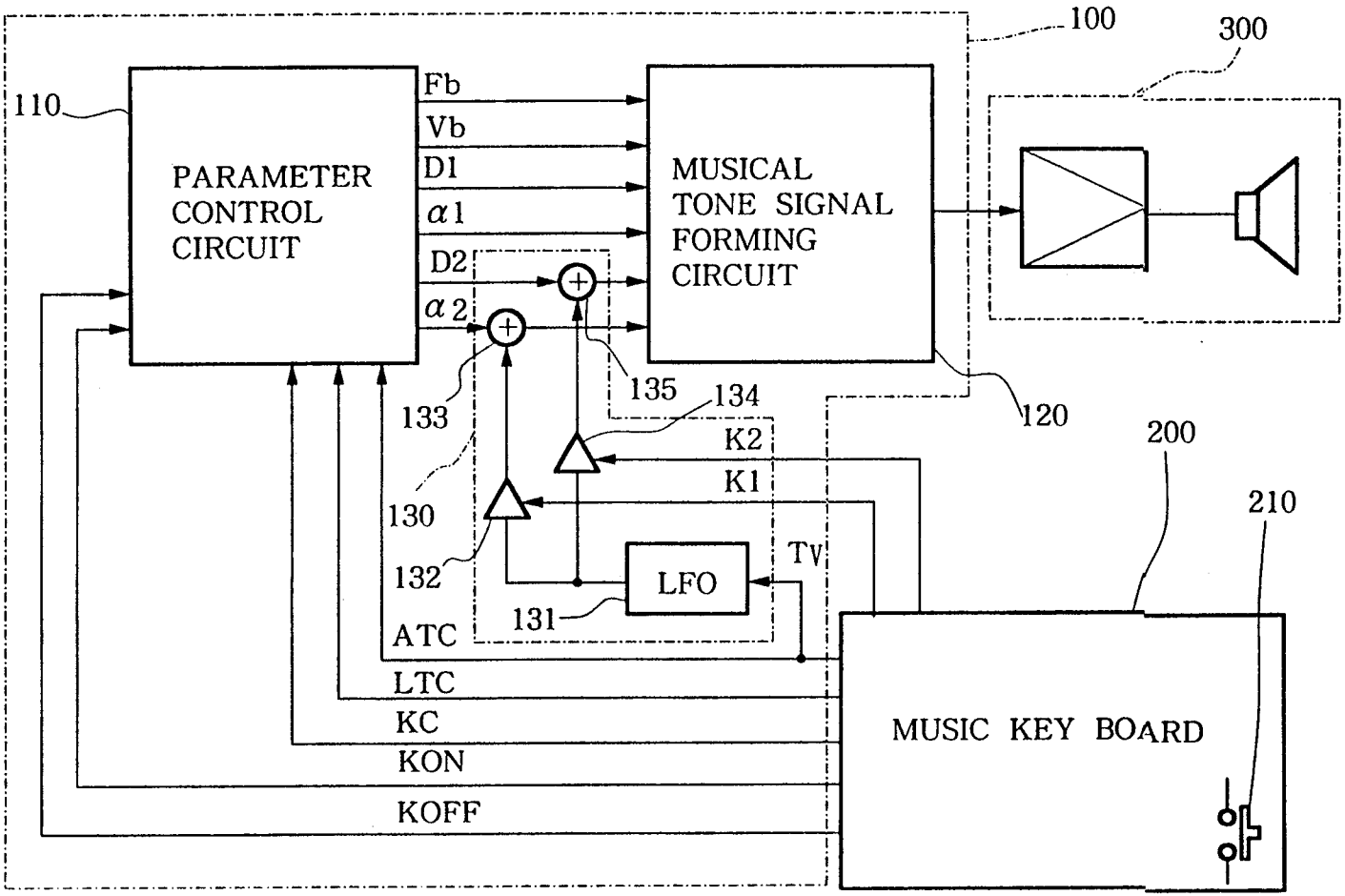
FIG. 1 is a block diagram showing the overall arrangement of an electronic musical instrument using a musical tone waveform signal forming apparatus according to an embodiment of the present invention.

FIG. 1 shows the overall arrangement of an electronic musical instrument to which a musical tone waveform signal forming apparatus according to an embodiment of the present invention is applied.

In FIG. 1, a musical tone waveform signal forming apparatus 100 simulates a physical structure of a bowed instrument by an electrical circuit (bowed string model). The apparatus 100 comprises a parameter control circuit 110 for generating various musical tone control parameters on the basis of performance data and musical tone data generated from a music keyboard 200, a delay feedback type musical tone signal forming circuit 120 for forming a musical tone waveform signal on the basis of the musical tone control parameters generated by the parameter control circuit 110, and a modulation control circuit 130 for modulating the musical tone control parameters to be supplied from the parameter control circuit 110 to the musical tone signal forming circuit 120 on the basis of vibrato data generated by the keyboard 200. The apparatus 100 modulates the musical tone control parameters, thereby adding a vibrato effect to a musical tone to be generated. A musical tone waveform signal outputted from the musical tone signal forming circuit 120 is supplied to a sound system 300 comprising an amplifier, a loudspeaker, and the like, and is produced as an acoustic wave.

In FIG. 1, the keyboard 200 comprises a keyboard consisting of a plurality of keys corresponding to a scale, and various circuits associated with the keyboard such as an ON key detection circuit for detecting the presence/absence of an ON operation of each key, an initial touch detection circuit for detecting an ON key speed, an after touch detection circuit for detecting an ON key pressure or an ON key depth, and the like. The keyboard 200 outputs performance data such as key ON data KON representing the presence of an ON key operation, key OFF data KOFF representing the presence of an OFF key operation, key code data KC representing a key subjected to the ON or OFF key operation, initial touch data ITC, after touch data ATC, and the like. The keyboard 200 also comprises an operation member for setting a vibrato level and instructing a vibrato mode, an operation member for setting tone color data, and operation detection circuits for these operation members, and outputs musical tone data such as vibrato data K1 K2, and Tv representing the presence/absence of the vibrato mode, and its content, selected tone color data, and the like. Of the vibrato mode data, coefficients K1 and K2 are those for determining a vibrato level. The coefficient K1 represents a degree of a change in frequency characteristics (tone color) of a musical tone by vibrato, and the coefficient K2 represents a degree of a change in pitch of a musical tone. The coefficient Tv represents a vibrato period. In this embodiment, as the coefficient Tv, the after touch data ATC is directly used.

In the musical tone waveform signal forming apparatus 100 shown in FIG. 1, the parameter control circuit 110 comprises, e.g., a microcomputer, a musical tone control parameter table, and the like, and looks up the table in accordance with the performance data and musical tone data to output various musical tone control parameters necessary for the musical tone signal forming circuit 120 to form a musical tone waveform signal. As the musical tone control parameters, a bow velocity signal Vb determined by the initial touch data ITC and representing a bow velocity of a bowed instrument, a bow pressure signal Fb determined by the after touch data ATC and representing a bow pressure of the bowed instrument, delay length signals D1 and D2 whose total amount is determined by the key code data KC, and which respectively represent resonance frequencies on a bridge side and a finger side to have a contact between a bow and a string of the bowed instrument as a boundary, and cutoff frequency signals $\alpha 1$ and $\alpha 2$ respectively representing acoustic characteristics of the string on the bridge and finger sides are formed. In this embodiment, a ratio D1/D2 of the delay lengths D1 and D2, and the cutoff frequencies $\alpha 1$ and $\alpha 2$ are set in advance in accordance with the kinds of musical instrument, tone colors, or the like. However, these parameters may be set or controlled by a player. An operation member which can provide the bow velocity Vb and bow pressure Fb independently of the initial and after touch data ITC and ATC may be prepared.

Figure 2:
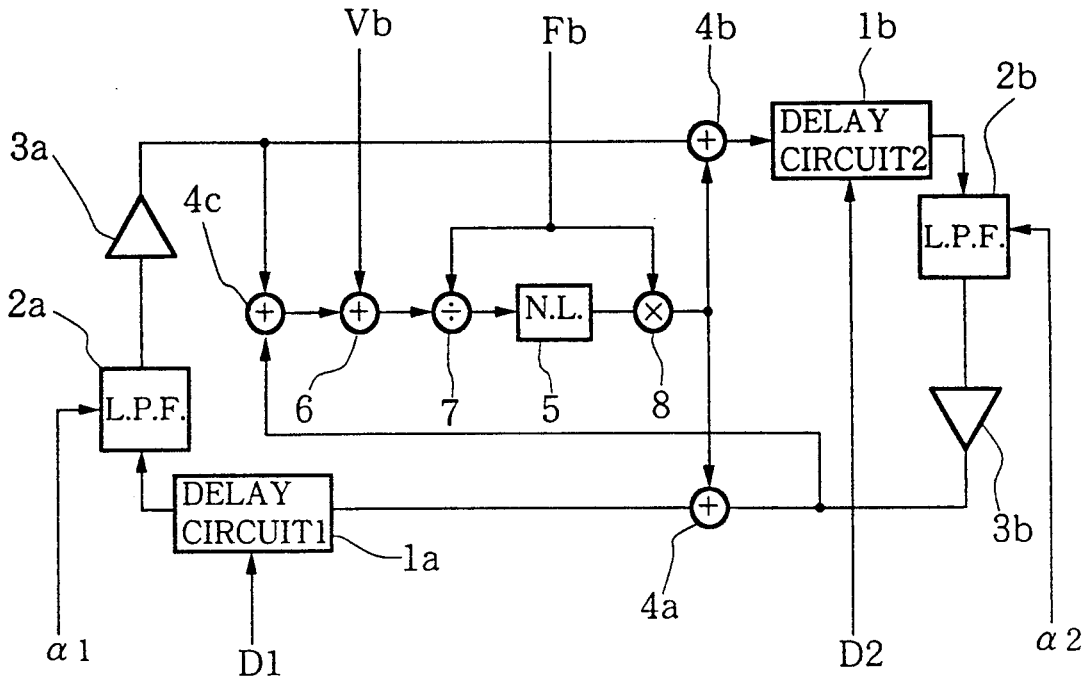
FIG. 2 is a circuit diagram showing a detailed arrangement of a musical tone signal forming circuit shown in FIG. 1.

FIG. 2 shows a detailed circuit arrangement of the musical tone signal forming circuit 120 shown in FIG. 1.

In FIG. 2, a closed loop including delay circuits 1*a* and 1*b*, low-pass filters (LPFs) 2*a* and 2*b*, multipliers 3*a* and 3*b*, and adders 4*a* and 4*b* simulates a string of a bowed instrument. The adders 4*a* and 4*b* correspond to a contact point between a string and a bow, i.e., a bowed string point. A closed loop including these adders (bowed string point) and on the left side of these adders simulates a portion between the bowed string point of the string and a bridge, and a closed loop on the right side of the adders simulates a portion between the bowed string point of the string, and a point pressed by a finger.

Delay lengths (delay times) D1 and D2 of the delay circuits 1*a* and 1*b* correspond to resonance frequencies of a string on the left side (bridge side) and the right side (finger side) of a bowed string point, and a total delay amount D1+D2 corresponds to a resonance frequency of a portion of one string between the bridge and a point pressed by a finger, i.e., a pitch of a musical tone to be generated.

Figure 3:
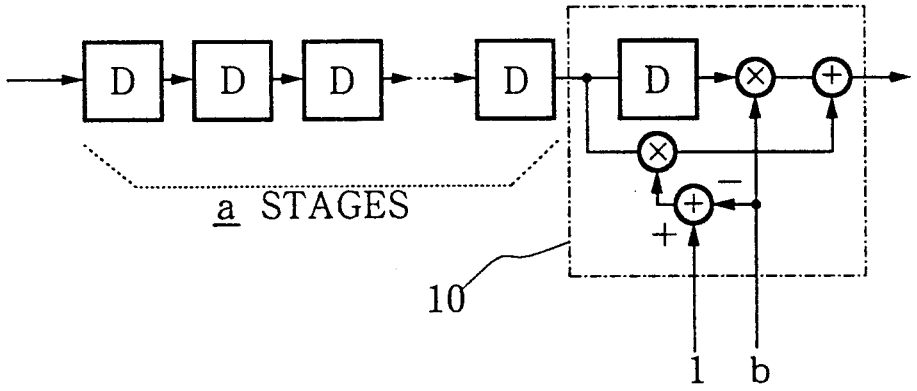
FIG. 3 is a circuit diagram showing a detailed arrangement of a delay circuit shown in FIG. 2.

FIG. 3 shows a detailed circuit arrangement of the delay circuits 1*a* and 1*b*. In FIG. 3, reference symbol D denotes a delay unit for delaying an input signal by one delay clock (e.g., one system clock), and outputting the delayed signal. Each delay unit D represents, e.g., one stage of a shift register. Reference symbol x in a circle designates a multiplier; and + in a circle, an adder. According to the arrangement shown in FIG. 3, the number of delay stages is set to be a in accordance with delay length data a +b whose integer part is represented by a, and whose decimal part is represented by b, and data b and 1 are inputted to a decimal delay section 10 to linearly interpolate within one delay clock, so that a delay amount smaller than an integer multiple of one delay clock can be controlled.

Figure 4:
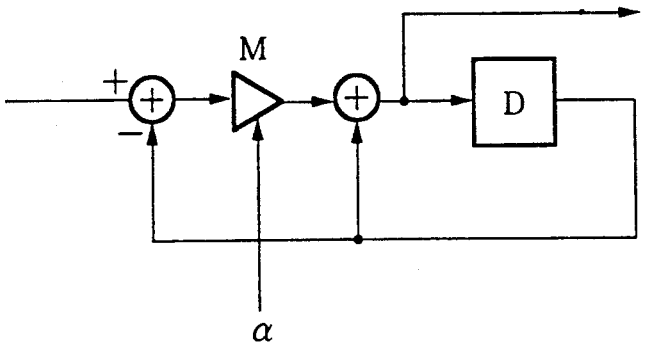
FIG. 4 is a circuit diagram showing a detailed arrangement of a low-pass filter shown in FIG. 2.
Figure 5A:
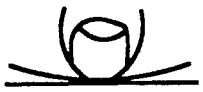
FIGS. 5A and 5B are views for explaining states of a finger pressing a string during vibrato performance of a bowed instrument.
Figure 5B:
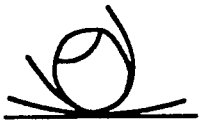

The LPFs 2*a* and 2*b* simulate acoustic transfer characteristics of a string on the bridge and finger sides, respectively. FIG. 4 shows an IIR low-pass filter as a detailed arrangement of the LPF 2*a* or 2*b*. In FIG. 4, $Z^{-1}$ designates a delay circuit for delaying input data by one period (sampling period) of a sampling pulse. In addition, symbol "+" designates an adder or subtractor for adding data inputted to an input terminal with or without a mark "+", and subtracting data inputted to an input terminal with a mark "−"; and M, a multiplier for multiplying an input signal with a predetermined coefficient. If a multiplication coefficient of the multiplier M is represented by $\alpha$, the LPF shown in FIG. 4 has transfer characteristics given by:

$$H(z) = \frac{\text{output}}{\text{input}} = \frac{\alpha}{1 - (1 - \alpha)Z^{-1}}$$

That is, the LPF shown in FIG. 4 is a digital primary low-pass filter having characteristics equivalent to those of an analog filter having a Laplacian transfer function given by:

$$H(s) = \frac{\text{output}}{\text{input}} = \frac{a}{a + s}$$

(where Fs is the sampling frequency, and Fc is the cutoff frequency)

Such a filter is disclosed in, e.g., Japanese Patent Laid-Open No. Sho 61-18212.

The multipliers 3*a* and 3*b* simulate string ends (reflection ends) of a string at the bridge and finger sides. Each multiplier multiplies an input signal with "−1", and outputs the product. Thus, the multiplier is used as a phase invertor. These multipliers 3*a* and 3*b* may be used as attenuators by multiplying a constant whose absolute value is smaller than 1.

A nonlinear converter 5 comprises a nonlinear function table, and nonlinearly converts a signal obtained by adding, by an adder 6, the signal Vb corresponding to a bow velocity to a signal obtained by synthesizing outputs from the bridge- and finger-side closed loops by an adder 4*c*. Input/output characteristics of nonlinear conversion are shifted or scaled by a divider 7 and a multiplier 8 in accordance with the bow pressure Fb.

In FIG. 1, the vibrato control circuit 130 comprises a low-frequency oscillator (LFO) 131 for generating a low-frequency signal in accordance with the coefficient Tv of vibrato data outputted from the keyboard 200, multipliers 132 and 134 for respectively multiplying the low-frequency signal with coefficients K1 and K2, and adders 133 and 135 for adding the products outputted from the multipliers 132 and 134 to the finger-side cutoff frequency $\alpha$2 and the finger-side delay length D2 outputted from the parameter control circuit 110. The control circuit 130 changes the finger-side cutoff frequency $\alpha$2 and the delay length D2 in accordance with the vibrato data outputted from the keyboard 200. The low-frequency signal has positive and negative amplitude levels, and can adjust a degree of filtering, and a degree of a change in pitch in accordance with the coefficients K1 and K2. Control of the filter and the delay length is preferably performed for the finger-side delay loop (closed loop) since it is more in accord with the concept that vibrato is caused by a variation in distance between a finger and a driving point (bowed string point). Of course, both finger- and bridge-side cutoff frequencies and delay lengths may be controlled when the string tension is mainly simulated for example.

In the above arrangement, when various performance data are outputted from the keyboard 200 on the basis of a keyboard operation, the parameter control circuit 110 generates the delay length data D1 and D2, the cutoff frequency data $\alpha$1 and $\alpha$2, the bow pressure data Fb, and the bow velocity data Vb in accordance with the input performance data, and supplies these data to the musical tone signal forming circuit 120. Thus, the musical tone signal forming circuit 120 forms a musical tone waveform signal having a pitch according to the total delay amount D1+D2, and a tone color according to the cutoff frequencies $\alpha$1 and $\alpha$2, the bow pressure Fb and the bow velocity Vb. This musical tone waveform signal is supplied to the sound system 300, and is produced as a musical tone.

The keyboard 200 comprises an operation member 210 for setting a vibrato level, and instructing a vibrato mode. When the operation member 210 is operated, the keyboard 200 generates vibrato data K1, K2, and Tv (i.e., ATC), and supplies these data to the vibrato control circuit 130. Thus, in the vibrato control circuit 130, the LFO 131 generates a low-frequency signal at least one of an amplitude and a frequency of which is modulated in accordance with the coefficient Tv. The low-frequency signal is scaled by the coefficient K1 by the multiplier 132, and the scaled signal is added to the finger-side delay length D2 from the parameter control circuit 110 by the adder 133. As a result, the finger-side delay length D2 is changed at a period according to the coefficient Tv and with an amplitude according to the coefficient K1. Therefore, in the musical tone signal forming circuit 120, the total delay amount D1+D2 is changed, and a pitch of a musical tone to be formed is changed. At the same time, the low-frequency signal outputted from the LFO 131 is scaled by the coefficient K2 by the multiplier 134, and the scaled signal is added to the finger-side cutoff frequency $\alpha$2 from the parameter control circuit 110 by the adder 135. As a result, the finger-side cutoff frequency $\alpha$2 is changed at a period according to the coefficient Tv and with an amplitude according to the coefficient K2. Therefore, in the musical tone signal forming circuit 120, the finger-side cutoff frequency $\alpha$2 is changed, and a tone color of a musical tone to be formed is changed.

In this manner, in this musical tone waveform signal forming apparatus, when a vibrato effect is added, a total delay amount D1+D2 corresponding to a string length, and the coefficient $\alpha$2 of the LPF 2*b* as the finger-side reflection filter are controlled, so that a vibrator musical tone can be naturally generated.

Modifications

The present invention is not limited to the above embodiment, and various modifications may be made.

For example, (1) The present invention is not limited to vibrato, but may be applied to a case wherein a modulation effect such as an attack pitch effect is to be added.

(2) Control parameters for adding a modulation effect may be controlled by the operation member such as a switch, as described above, or may be controlled based on initial or after touch data of the keyboard.

(3) In the above embodiment, the present invention is realized by a musical tone waveform forming algorithm which simulates a bowed instrument, but may be realized by other algorithms for percussions, plucked string instruments, wind instruments, and the like.

(4) In the above embodiment, the present invention is realized in a hardware manner but may be realized in a software manner, e.g., by a microprogram.

(5) In the above embodiment, time-divisional multiplex processing may be performed.

(6) In the above embodiment, the delay circuit may comprise a RAM, or may comprise any other delay means.

(7) In the above embodiment, when a modulation effect is added, the bow velocity Vb, the bow pressure Fb may also be additionally controlled.

(8) In the above embodiment, the filter which is in the loop is modulated, but a filter which filters the musical tone signal output from the loop may be modulated.

What is claimed is:

1. A musical tone waveform signal forming apparatus comprising:

loop means for connecting delay means for delaying a signal input thereto and filter means for filtering said signal in a loop state;

excitation means for inputting said signal to said loop means so that a musical tone signal is formed in said loop means;

modulation instruction means for generating a modulation instruction signal;

delay control means for varying delay length of said delay means based on said modulation instruction signal with a lapse of time so that the pitch of the musical tone signal is varied; and filter control means for varying a filtering characteristic of said filter means with a lapse of time based on said modulation instruction signal so that tone color of said musical tone signal is varied.

2. A musical tone waveform signal forming apparatus according to claim 1 wherein said filter means comprises a low pass filter whose cut off frequency is varied based on said modulation instruction means.

3. A musical tone waveform signal forming apparatus according to claim 2 wherein said cut off frequency is varied as said delay length is varied.

4. A musical tone waveform signal forming apparatus according to claim 1, further comprising:

tone producing means for producing a musical tone in response to said musical tone signal, wherein said musical tone is varied in pitch and tone color with a lapse of time based upon said modulation instruction signal.

5. A musical tone waveform signal forming apparatus comprising:

loop means for connecting delay means for delaying a signal input thereto and filter means for filtering said signal in a loop state;

excitation means for inputting said signal to said loop means, so that a musical tone signal is formed in said loop means;

modulation means for generating a modulation signal varying with a lapse of time;

delay control means for modulating delay length of said delay means based on said modulation signal so that pitch modulation is effected on said musical tone signal; and, filter control means for modulation a filtering characteristic of said filter means based on said modulation signal so that tone color modulation is effected to said musical tone signal.

6. A musical tone waveform signal forming apparatus according to claim 5 wherein said filter means comprising a low pass filter, said filtering characteristic includes cut off frequency of said low pass filter, so that said cut off frequency is modulated by said filter control means based on said modulation signal.

7. A musical tone waveform signal forming apparatus according to claim 5 wherein said modulation signal varies periodically.

8. A musical tone waveform signal forming apparatus according to claim 7 wherein a period of a variation of said filtering characteristic and a period of a variation of said delay length are harmonized.

9. A musical tone waveform signal forming apparatus according to claim 8 wherein a phase of a variation of said filtering characteristic and a phase of a variation of said delay length are harmonized.

10. A musical tone waveform signal forming apparatus according to claim 9 wherein said filter means comprising a low pass filter, said filtering characteristic includes cut off frequency of said low pass filter, so that said cut off frequency is modulated by said filter control means based on said modulation signal.

11. A musical tone waveform signal forming apparatus according to claim 10 wherein a short delay length results in a high pitch and a long delay length results in a low pitch and wherein said cut off frequency is relatively high when said delay length is short and said cut off frequency is relatively low when said delay length is long.

12. A musical tone waveform signal forming apparatus according to claim 10 wherein a short delay length results in a high pitch and a long delay length results in a low pitch and wherein said cut off frequency is relatively high when said delay length is long and said cut off frequency is relatively low when said delay length is short.

13. A musical tone waveform signal forming apparatus according to claim 5, further comprising:

tone producing means for producing a musical tone in response to said musical tone signal, wherein said musical tone is varied in pitch and tone color with a lapse of time based upon said modulation signal.

14. A musical tone waveform signal forming apparatus comprising:

loop means including delay means for delaying a signal input thereto, first filter means for filtering said signal, and second filter means for filtering said signal and connected in a loop state;

excitation means for inputting said signal to said loop means so that a musical tone signal is formed in said loop means;

modulation means for generating a modulation signal varying with a lapse of time;

delay control means for modulating delay length of said delay means based on said modulation signal so that pitch modulation is effected to said musical tone signal; and, filter control means for modulating a filtering characteristic of only either of said first and second filter means based on said modulation signal so that tone color modulation is effected to said musical tone signal.

15. A musical tone waveform signal forming apparatus according to claim 14 wherein said first filter means comprising a low pass filter, said filtering characteristic includes cut off frequency of said low pass filter, so that said cut off frequency is modulated by said filter control means based on said modulation signal.

16. A musical tone waveform signal forming apparatus according to claim 14 wherein said second filter means comprising a low pass filter, said filtering characteristic includes cut off frequency of said low pass filter, so that said cut off frequency is modulated by said filter control means based on said modulation signal.

17. A musical tone waveform signal forming apparatus according to claim 14, further comprising:

tone producing means for producing a musical tone in response to said musical tone signal, wherein said musical tone is varied in pitch and tone color with a lapse of time based upon said modulation signal.

18. A musical tone waveform signal forming apparatus comprising:

loop means including delay means for delaying a signal input thereto, first filter means for said signal, and second filter means for filtering said signal and connected in a loop state;

excitation means for inputting said signal to said loop means, so that a musical tone signal is formed in said loop means;

modulation means for generating a modulation signal varying with a lapse of time;

delay control means for modulating delay length of said delay means based on said modulation signal so that pitch modulation is effected to said musical tone signal; and, filter control means for modulating filtering characteristics of both of said first and second filter means based on said modulation signal so that tone color modulation is effected to said musical tone signal.

19. Amusical tone waveform signal forming apparatus according to claim 18 wherein said first filter means comprising a low pass filter, said filtering characteristic includes cut off frequency of said low pass filter, so that said cut off frequency is modulated by said filter control means based on said modulation signal.

20. A musical tone waveform signal forming apparatus according to claim 17 wherein said second filter means comprising a low pass filter, said filtering characteristic includes cut off frequency of said low pass filter, so that said cut off frequency is modulated by said filter control means based on said modulation signal.

21. A musical tone waveform signal forming apparatus according to claim 18, further comprising:

tone producing means for producing a musical tone in response to said musical tone signal, wherein said musical tone is varied in pitch and tone color with a lapse of time based upon said modulation signal.

22. A musical tone waveform signal forming apparatus comprising:

loop means including first delay means for delaying a signal input thereto, second delay means for delaying said signal, first filter means for filtering said signal, and second filter means for filtering said signal and connected in a loop state;

excitation means for inputting said signal to said loop means, so that a musical tone signal is formed in said loop means, wherein said loop means connects each of said means serially according to the order of first delay means, first filter means, second delay means, and second filter means, wherein said excitation means inputs said signal to a line between said first filter means and said second delay means, and to a line between second filter means and first delay means;

modulation means for generating a modulation signal varying with a lapse of time;

delay control means for modulating delay length of only said first delay means based on said modulation signal so that pitch modulation is effected to said musical tone signal; and, filter control means for modulating a filtering characteristic of only said first filter means based on said modulation signal so that tone color modulation is effected to said musical tone signal.

23. A musical tone waveform signal forming apparatus according to claim 22 wherein said first filter means comprising a low pass filter, said filtering characteristic includes cut off frequency of said low pass filter, so that said cut off frequency is modulated by said filter control means based on said modulation signal.

24. A musical tone waveform signal forming apparatus according to claim 22 wherein said second filter means comprising a low pass filter, said filtering characteristic includes cut off frequency of said low pass filter, so that said cut off frequency is modulated by said filter control means based on said modulation signal.

25. A musical tone waveform signal forming apparatus according to claim 22, further comprising:

tone producing means for producing a musical tone in response to said musical tone signal, wherein said musical tone is varied in pitch and tone color with a lapse of time based upon said modulation signal.

26. A musical tone waveform signal forming apparatus comprising:

loop means including first delay means for delaying a signal input thereto, second delay means for delaying said signal, first filter means for filtering said signal, and second filter means for filtering said signal and connected in a loop state;

excitation means for inputting said signal to said loop means, so that a musical tone signal is formed in said loop means, wherein said loop means connects each of said means serially according to the order of first delay means, first filter means, second delay means, and second filter means, wherein said excitation means inputs said signal to a line between said first filter means and said second delay means, and to a line between second filter means and first delay means;

modulation means for generating a modulation signal varying with a lapse of time;

delay control means for modulating delay lengths of both said first and second delay means based on said modulation signal so that pitch modulation is effected to said musical tone signal; and, filter control means for modulating filtering characteristics of both said first and second filter means based on said modulation signal so that tone color modulation is effected to said musical tone signal.

27. A musical tone waveform signal forming apparatus according to claim 26 wherein said first filter means comprising a low pass filter, said filtering characteristic includes cut off frequency of said low pass filter, so that said cut off frequency is modulated by said filter control means based on said modulation signal.

28. A musical tone waveform signal forming apparatus according to claim 26 wherein said second filter means comprising a low pass filter, said filtering characteristics includes cut off frequency of said low pass filter, so that said cut off frequency is modulated by said filter control means based on said modulation signal.

29. A musical tone waveform signal forming apparatus according to claim 26, further comprising:

tone producing means for producing a musical tone in response to said musical tone signal, wherein said musical tone is varied in pitch and tone color with a lapse of time based upon said modulation signal.

30. A musical tone waveform signal forming apparatus comprising:

delay means for delaying a signal input thereto, wherein an output of said delay means is fed back to an input of said delay means, so that a loop is formed;

excitation means for inputting said signal to said loop, so that a musical tone signal is formed in said loop;

filter means for filtering said musical tone signal according to a filtering characteristic of said filter means; and, modulation means for generating a modulation signal varying with a lapse of time, wherein delay length of said delay means and said filtering characteristic of said filter means are varied with a lapse of time based on said modulation signal, whereby pitch modulation and tone color modulation is effected on said musical tone signal.

31. A musical tone waveform signal forming apparatus according to claim 30 wherein said filter means is includes in said loop.

32. A musical tone waveform signal forming apparatus according to claim 30 wherein said filter means comprises a low pass filter, and said filtering characteristic includes cut off frequency of said low pass filter.

33. A musical tone waveform signal forming apparatus according to claim 30 wherein said modulation means comprises a low frequency oscillator (LFO).

34. A musical tone waveform signal forming apparatus according to claim 30, further comprising:

tone producing means for producing a musical tone in response to said musical tone signal, wherein said musical tone is varied in pitch and tone color with a lapse of time based upon said modulation signal.

* * * * *